United States Patent [19]

Hell et al.

[11] 3,992,965

[45] Nov. 23, 1976

[54] METHOD AND ARRANGEMENT FOR CUTTING AND SORTING PHOTOGRAPHIC PRINTS, AND THE LIKE

[75] Inventors: August Hell, Feldkirchen; Klaus Weber; Eberhard Escales, both of Munich, all of Germany

[73] Assignee: AGFA-Gevaert, A.G., Leverkusen, Germany

[22] Filed: Sept. 24, 1975

[21] Appl. No.: 616,417

[30] Foreign Application Priority Data

Sept. 26, 1974 Germany ..... 2445999

[52] U.S. Cl. ..... 83/27; 83/63; 83/80; 83/364; 83/371

[51] Int. Cl.[2] ..... B26D 5/38

[58] Field of Search ..... 83/27, 63, 79, 80, 364, 83/371, 105, 106; 209/73, 74

[56] References Cited

UNITED STATES PATENTS 3,631,979 1/1972 Frankiewicz ..... 209/74

3,706,373 12/1972 Smith ..... 83/106 X

*Primary Examiner*—Willie G. Abercrombie

*Attorney, Agent, or Firm*—Michael J. Striker

[57] ABSTRACT

Each customer order has the form of an image band segment comprised of one or more image sections bearing respective images. The customer order image band segments together form an elongated image band. The image band is provided with order marks of different types, each image section of one customer order being provided with an order mark of one type, and each image section of the next customer order being provided with an order mark of another type, so that the order mark type changes from one customer order to the next on the image band. The changes of order mark type are detected using a detecting arrangement which is operative for generating control signals in dependence upon such detection. The operation of an order-sorting arrangement is controlled by applying the control signals thereto.

26 Claims, 15 Drawing Figures

METHOD AND ARRANGEMENT FOR CUTTING AND SORTING PHOTOGRAPHIC PRINTS, AND THE LIKE

BACKGROUND OF THE INVENTION

The invention relates to a method and arrangement for severing individual image segments from an image band and for the sorting of customer orders comprised of image band segments each including one or more image sections (e.g., photographic prints). More particularly, the invention relates to the control of cutting and sorting means in response to the reading of specially provided marks on the image band indicative of the end of a customer order and indicative of the individual image sections to be severed from the band.

In most printers of modern construction, to sever the individual image sections, there are provided on rolls of paper one cut mark per image section and spaced therefrom an order-separating mark at the end of each customer order. The cut marks are detected by an automatic cutting arrangement and are used to control the cutting operation. The end-of-order mark serves to effect separation of individual customer orders, usually in the following steps:

The photoelectrically or mechanically detected end-of order mark effects an interruption of the cutting operation. Thereafter, the accumulated stack of severed image sections (e.g., prints) are manually removed from the accumulating location, the number of image sections is counted for invoicing purposes and the automatic cutting arrangement is reactivated for the next customer order.

A problem with this method is that with the present state of the marking art, weakly formed marks are not detected and dirt on the image section or surface defects may be read as being proper marks.

Defective detection of a cut mark leads to double image sections or to chopped up image sections. Defective detection of an end-of-order mark causes the image sections of the second order to be stacked on top of the images of the first order, or else results in the splitting up of a single order into two stacks, and can result in improper insertion of the next-following order into a print wallet or envelope, if a visual comparison between the image sections (prints) and the film is not performed. With automated processing, both types of detection failures lead to serious operating malfunctions, such as uninterrupted stacking of image sections (prints), order mix-ups and splitting, and invoicing errors.

SUMMARY OF THE INVENTION

It is an object of the invention to provide a method and apparatus which guarantee error-free detection of the marks and, if necessary, automatic termination of operation but without unnecessary frequency.

This object can be achieved according to the invention in that the individual image sections belonging to one order are all provided with order marks of the same type, with the individual image sections belonging to the next order all being provided with order marks of another type, so that the order mark type changes in going from one customer order to the next.

Due to the use of a plurality of marks for indicating one order and for indicating the end of one order and the start of the next, in the unlikely event that the first order mark of a new order is not properly detected, it will not happen, as was hitherto the case, that the new order in its entirety will be processed as though it were part of the preceding order; instead, only the first image section (e.g., print) of the new order will be so processed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

In the exemplary versions of the invention shown in FIGS. 1–7, there are provided on the band B two separate tracks for synchronizing or order marks SYM1 and SYM2, and an additional track for cut marks SM. When a plurality of film strips are received from a plurality of customers, they are glued together to form very long strips suitable for high-speed automatic film processing or printing set-ups. Thereafter, synchronizing and cut marks are provided along the length of the exposed print paper made from the film strips, to identify individual prints in order to make possible individual severing of each print from the band, and to indicate where one customer's order ends and another customer's order begins.

Figure 1:
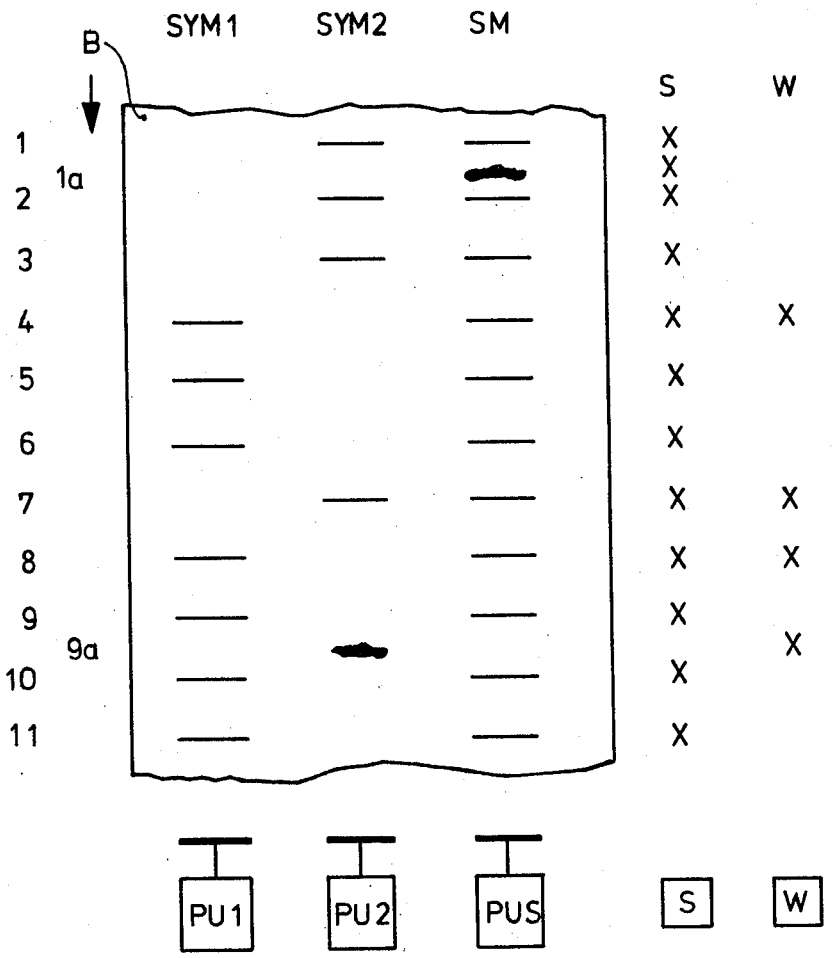
FIGS. 1–7 diagrammatically illustrate sever versions of the invention, in which three tracks are used for marks, together with the various detecting and control arrangements involved.

In FIG. 1, it is to be noted that all the successive prints in one customer order are provided with synchronizing or order marks in only one track (e.g., SYM1), whereas all the successive prints in the next-following customer order are provided with synchronizing marks in only the other track (e.g., SYM2), and that each print is provided with a cut mark in the cut mark track SM. For simplicity, both the track and the marks within a track are given the same designation, so that for example the track SYM1 contains synchronizing marks SYM1, etc. The individual prints constitute image sections; the groups of prints associated with one customer order constitute an image band segment; and the customer orders together form the image band.

For the marking set-ups in FIGS. 1–7, it is preferred to provide the printing apparatus with three marking devices and with three photoelectric detectors PU1, PU2, PUS. The making of the marks on the printing paper band B (referred to as the "band") can be performed in a semiautomatic manner.

FIG. 1 depicts the simplest version. The marks in tracks SYM1, SYM2, SM are detected by detectors PU1, PU2, PUS. The marks associated with one print are all arranged in one line (11 shown). The arrow at the upper left corner indicates the order in which the lines are read. The lines 1–11 are read one line at a time.

In FIG. 1, to the right of tracks SYM1, SYM2, SM, there is indicated, for purposes of explanation, a tabulation of automatic cutting and order-separating operations. An "X" in column S, at the level of a particular line, indicates that the marks in that line cause the performance of an automatic cutting operation. An X in column W, at the level of a particular line, indicates that the marks in that line cause the performance of an automatic order-separating operation.

In the embodiment of FIG. 1, the performance of an automatic cutting operation, for severing a single print from the band of printing paper, depends exclusively upon the presence of a cut mark SM in the line associated with that print. This is indicated by the presence of an X in column S at each and every line (or pseudo-line such as 1*a* or 9*a*) at which is present a cut mark SM.

In the embodiment of FIG. 1, the performance of an automatic order-separating operation is dependent exclusively upon a change of the location of synchronzing marks from one to the other of the tracks SYM1, SYM2. This is indicated by the presence of an X in column W at each line (or pseudo-line) in which the synchronizing mark SYM occupies a track different from the track occupied by the synchronizing mark SYM of the preceding line.

The automatic order-separating operation may for example involve the pushing of an accumulated stack or severed prints into an order envelope, or another such operation.

In the embodiment of FIG. 1, the control of the automatic cutting operation by the cut marks SM, on the one hand, and the control of the automatic order-separating operation, on the other hand, are completely independent of each other. As a result, there exists a considerable possibility of improper cutting and order-separating operations. For example, in pseudo-line 1*a* there is present a defect which is mistakenly perceived by the detector PUS as being a proper cut mark SM, thereby causing the cutting operation to be performed.

In going from line 3 to line 4, the location of the synchronizing mark changes from track SYM2 to track SYM1, thereby activating the order-separating means W. In going from line 6 to line 7, the location of the synchronizing mark changes from track SYM1 to track SYM2, likewise activating the order-separating means W. Proper activation of means W also occurs in response to the change of track in going from line 7 to line 8.

However, in pseudo-line 9*a* there is present in track SYM2 a defect which is mistakenly perceived by the detector PU2 as a proper synchronizing mark; because this defect is in track SYM2 whereas the synchronizing mark in previous line 9 was in track SYM1, an automatic order-separating operation is performed (as indicated by the X in column W). As a result, the prints corresponding to lines 8, 9, 10 and 11, although they all belong to a single order, as indicated by the presence of all their associated synchronizing markings in one synchronizing track, are improperly split into two groups, as if they belonged to two different orders. It should be noted that actually two improper order-discriminating operations are performed, one in going from line 9 to pseudo-line 9*a*, and the other in going from pseudo-line 9*a* to line 10.

Figure 2:
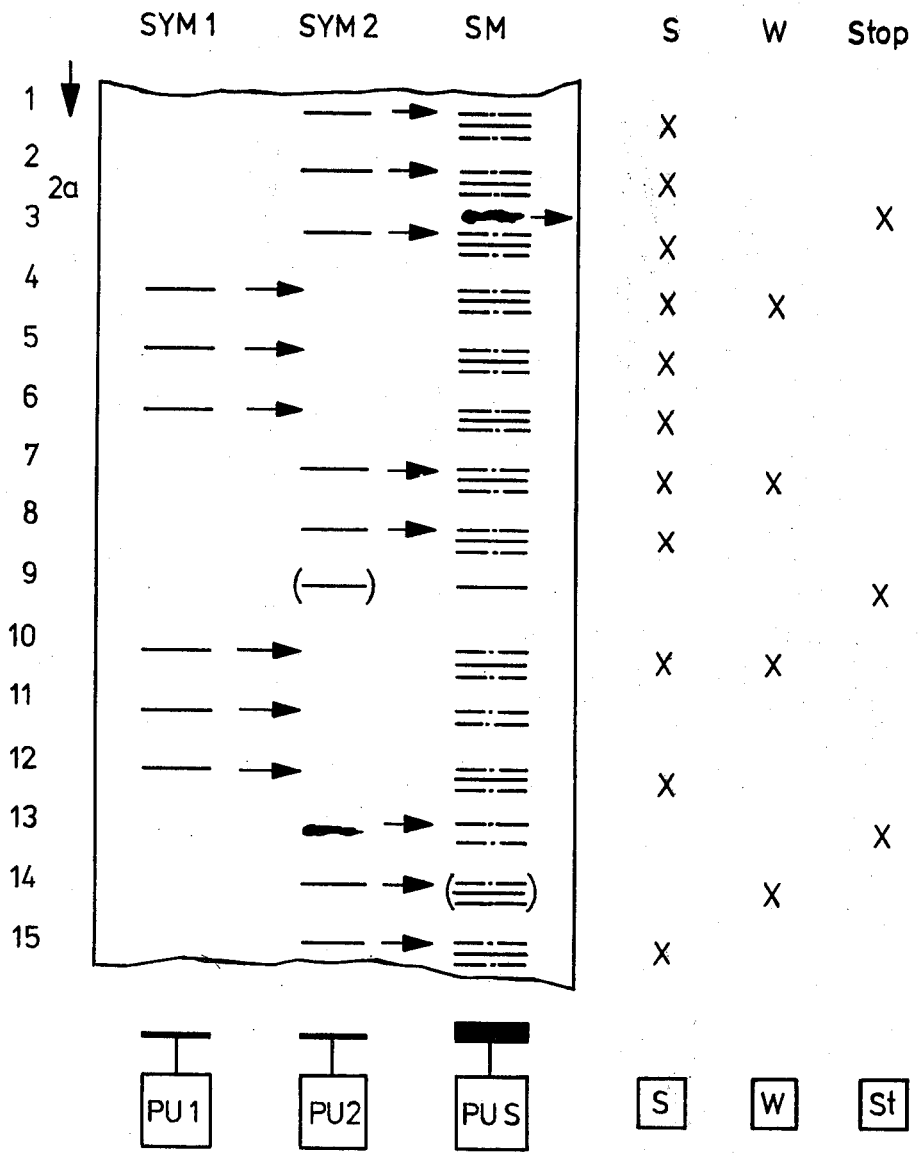

FIG. 2 illustrates a second embodiment of the invention, which is somewhat more sophisticated and improved. In FIG. 2, the symbols and tabulation have the same meaning as explained with respect to FIG. 1. However, there is an additional stop tabulation, corresponding to a stop means S*t*. When activated, the stop means S*t* causes the transport of the printing band to be interrupted, so that a malfunction can be manually corrected. The meanings of the left-to-right arrows, the dash-dot-dash lines in track SM, and the parentheses will be explained below.

The main difference between the embodiment of FIG. 2 and that of FIG. 1, is that in FIG. 2 the detection of a cut mark in track SM is not only the condition precedent to the activation of the automatic cutting means S. Instead, both a synchronizing mark SYM and a cut mark SM must be detected to effect activation of means S.

The detection of a synchronizing mark SYM in FIG. 2, besides its role in discriminating between different customer orders, results in the enablement of a coincidence gate. When the detector PUS detects a cut mark SM it generates a signal which is applied to such coincidence gate. The gate can for example have its output directly connected to the control input of the cutting means SM, so that cutting means S cannot be activated in response to the detection of a cut mark SM unless a synchronizing mark SYM has also been detected.

In FIG. 2, the fact that a cut mark SM does not activate the cutting means S unless a synchronizing mark SYM has been detected is indicated by the left-to-right arrows. In other words, detection of a synchronizing mark SYM is a condition precedent to the cut mark SM having any effect.

In FIG. 2, the cut marks in track SM are the solidline marks. The two dash-dot-dash lines located to either side of each cut mark SM indicate the limits within which the cut mark SM must be located if the cut mark is to cause activation of the cutting means S.

It will be noted that each cut mark SM is slightly preceded by its associated synchronizing mark SYM. This is readily achieved by establishing a proper offset between the marking devices in the printing apparatus.

The establishment of the zone of effectiveness intermediate each pair of horizontal dash-dot-dash lines in track SM can be effected very simply by correspondingly dimensioning the zone of detection-capability of the detector PUS; this is indicated schematically in FIG. 2 by showing the slit-shaped sensing area of detector PUS to be broader than the slit-shaped sensing areas of detectors PU1 and PU2. Also, the relative positions of the three slit-shaped sensing areas are schematically indicated in this way.

The purpose of having the synchronizing mark SYM precede the associated cut mark SM is to ensure that, even at very high transport speeds, the enablement of the coincidence gate effected in response to detection of a synchronizing mark SYM will have been completed before the detection of the associated cutting mark SM; otherwise, the coincidence gate might not have time enough to ready itself for the transmission of a signal to cutting means S in response to detection of the cutting mark SM.

Upon the detection of a synchronizing mark, whether in track SYM1 or in track SYM2, the cutting means S will be activated if a cutting mark is detected as being located in the associated rectangular sensing area on the track SM. If a cut mark in track SM is detected as being located outside such rectangular sensing area, not the cutting means S, but instead the stop means S*t* will be activated, to terminate transport of the printing paper, so that the malfunction can be manually corrected.

For example, in pseudo-line 2*a* the defect in the cut mark track SM does not activate the cutting means S, because there is no associated synchronizing mark SYM to enable the coincidence gate during the detection of the defect; as a result, the stopping means S*t* is activated. The same thing occurs in line 9, where the cut mark SM does have associated with it a synchronizing mark in track SYM2, but the synchronizing mark is too weak or pale to be detected; the parentheses indicate that a marking operation has been performed but that the mark produced is defective and not detectable.

In line 11, there is no synchronizing mark associated with the cut mark. This corresponds to a splice location on the film strip or band, and the band transport is not interrupted.

The situation is different in going from line 12 to line 13. In line 13 there is a defect on the track SYM2, having associated with it no cut mark SM. The change of track of the defect in line 13, relative to the synchronizing mark SYM in line 12, because the defect in line 13 is not accompanied by a cut mark SM, causes the stop means S*t* to be activated.

In FIG. 2, as in FIG. 1, the order-separating means 1 is activated when from one line to the next the synchronizing mark SYM changes track. This occurs for example in the transitions from lines 3 to 4, 6 to 7, 8 to 10, and 12 to 14.

With the approach illustrated in FIG. 2, if the synchronizing track is detected as having changed, and if the track change is not proper but instead attributable to a defect in one of the synchronizing tracks or to the failure to detect one of the preceding synchronizing marks, activation of the other-separating means is precluded with almost complete certainty.

However, the system of FIG. 2 is not better than more conventional systems with respect to malfunction resulting from failure to detect pale or otherwise incompletely formed cut marks SM. On the other hand, this shortcoming can be compensated for to some extent by increasing the sensitivity of the photoelectric detectors PU1, PU2, PUS to an extent not possible with similar conventional systems. This is because defects can be distinguished from proper marks; when such distinction cannot be made, then it is in general necessary to use low-sensitivity detectors, so that the detectors will respond only to visually strong marks, assumed to have been deliberately made and not to be mere surface defects.

Figure 3:
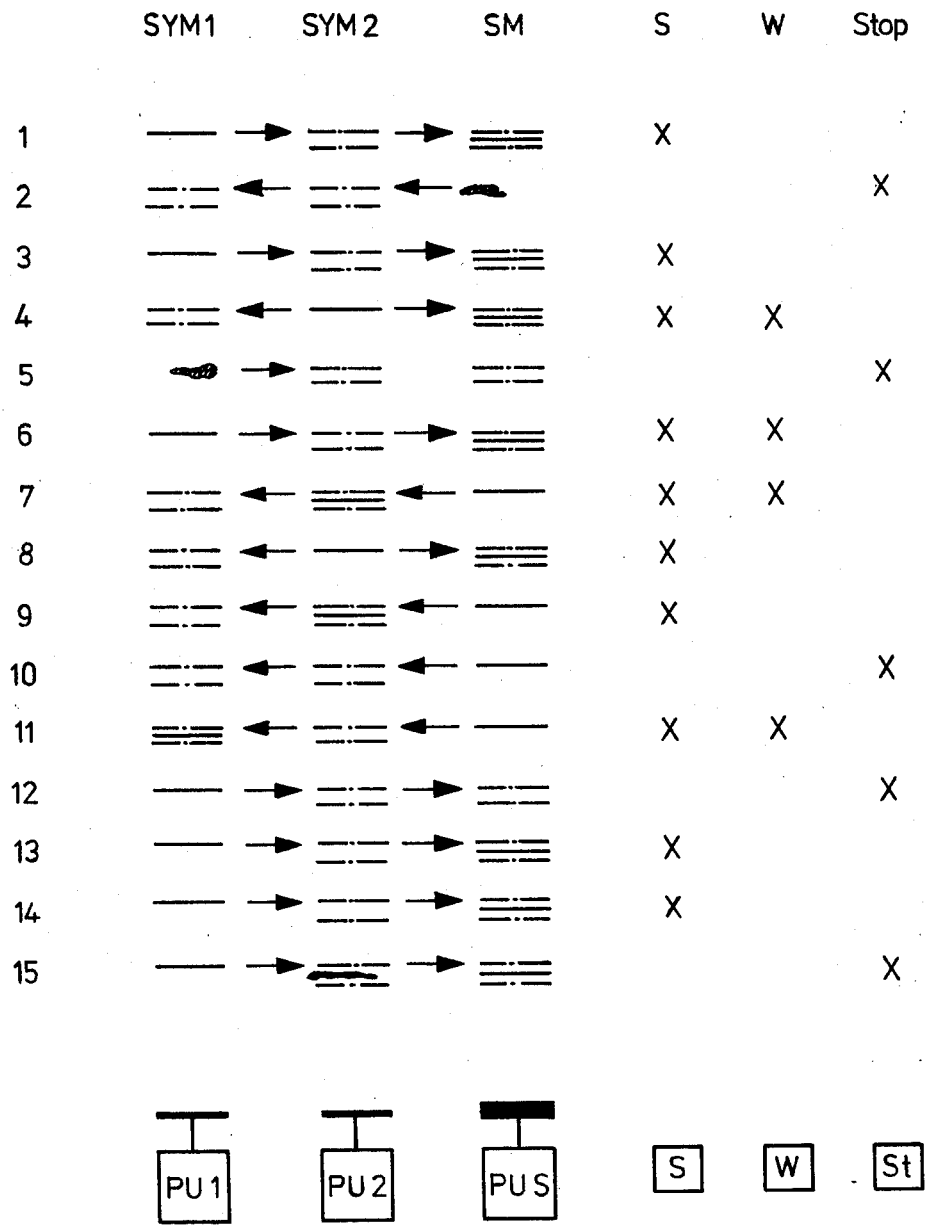

FIG. 3 illustrates another approach according to the invention. Whereas in FIG. 2 a synchronizing mark SYM enabled a gate for the passage of the signal generated upon detection of a cut mark SM, in FIG. 3 the first mark to be detected in a line of whichever type enables a gate for the passage of a signal generated upon detection of a second mark of the second type. If a second mark of the second type is not detected, then the stop means S*t* is activated, causing the band transport to cease. Improper cutting operations and order mix-ups can occur only if two defective marks, of two different types, are simultaneously detected, which will happen almost never.

As a result, the reliability of the automatic control of the cutting and order-separating operations is very high. An automatic sorting out of empty strips (such as leaders, or the like) can be achieved by providing no cut marks and no synchronizing marks on the empty strips. If synchronizing marks in both synchronizing tracks SYM1, SYM2 are detected simultaneously, or if during the time a synchronizing mark holds a gate enabled two cut marks are detected, activation of the cutting means S is automatically prevented and the stop means S*t* is activated.

In FIG. 3, line 2, there is a surface defect on track SM. This surface defect enables the gates for the two synchronizing tracks. However, because no synchronizing marks are detected during the time of gate enablement, the stopping means S*t* is automatically activated.

The stopping means S*t* will likewise be automatically activated, to interrupt band transport, if (as shown in line 5) a surface defect in one of the synchronizing tracks enables the gate for the cut mark track and then no cut mark is detected during the time of gate enablement.

In lines 10 and 12, instead of irregular surface defects in the synchronizing or cut mark tracks, there are present in these tracks regular marks of the proper shape. However, in line 10, there is no synchronizing mark associated with the mark in the cut mark track SM; and in line 12, there is no cut mark associated with the mark in synchronizing track SYM1. As a result, when each of lines 10 and 12 is read, the stop means S*t* is automatically activated.

In line 15, the marks in synchronizing track SYM1 and in cut mark track SM are proper; however, the presence of a surface defect in track SYM2, detected as being a second synchronizing mark, causes the stop means S*t* to be automatically activated.

In the system of FIG. 3, as in those of FIGS. 1 and 2, the order-separating means W is automatically activated in response to the detection of a change of synchronizing track. The synchronizing track changes in a proper manner in lines 4, 6, 7 and 11.

Figure 4:
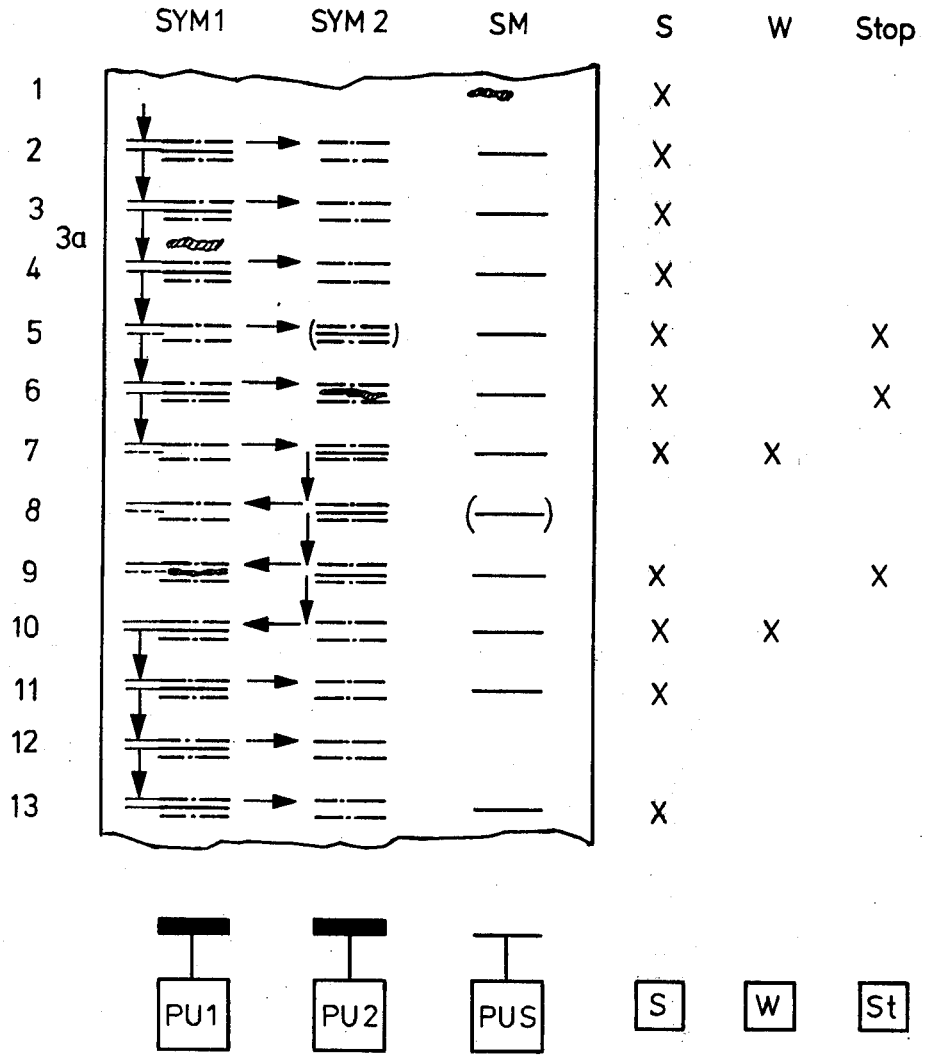

With the arrangement illustrated in FIG. 4, after detection of a synchronizing mark the position and size of the gate enablement for the subsequent marks is set.

In the event of no detection or double detection, then as in the previously described embodiments, the stop means S*t* is activated. Actually, the reliability of the automatic cutting operations is not increased, because the cut marks control the cutting means independently of the synchronizing marks; however, a loss of synchronism (order mix-up or splitting) is made impossible. The automatic sorting out of an empty strip (such as a leader or trailer) is made possible by providing the empty strip with an uninterrupted series of synchronizing marks.

The surface defect in line 1 of FIG. 4 causes an automatic cutting operation to be improperly performed. In contrast, the surface defect in track SYM1, pseudo-line 3*a*, does not improperly initiate any operation, because it lies outside the area corresponding to the gate enablement effected for line 4 by the synchronizing mark in track SYM1, line 3. This is indicated symbolically by the downward arrow extending from line 3 to line 4. This arrow extends downwards from the level of the (solid-line) synchronizing mark in line 3 to the level of the upper dash-dot-dash line of line 4. The space between the two dash-dot-dash lines in each line of the band indicates the location and size of the region corresponding to the gate enablement effected by a synchronizing mark in the preceding line. The broken line in track SYM1, lines 7, 8 and 9 indicates where a proper synchronizing mark would be, if one were present.

No synchronizing mark will be detected in line 5, and two synchronizing marks will be detected in each of lines 6 and 9; for both these situations, the stop means S*t* will be automatically activated.

In line 8, the cut mark SM is not detected, because it is imperfectly formed (e.g., too pale). As a result, the cutting means S is not activated, and a double print will be fed out, similar to the empty strip corresponding to line 12.

In FIG. 4, the relative positions and sizes of the regions within which a mark must be located to be detected coincidentally with another mark in the same line are indicated by the sizes and offset of the schematically depicted scanning slits of the detectors PU1, PU2, PUS. The scanning slits for detectors PU1, PU2 have the same size and position, whereas that for detector PUS is shorter and offset.

Figure 5:
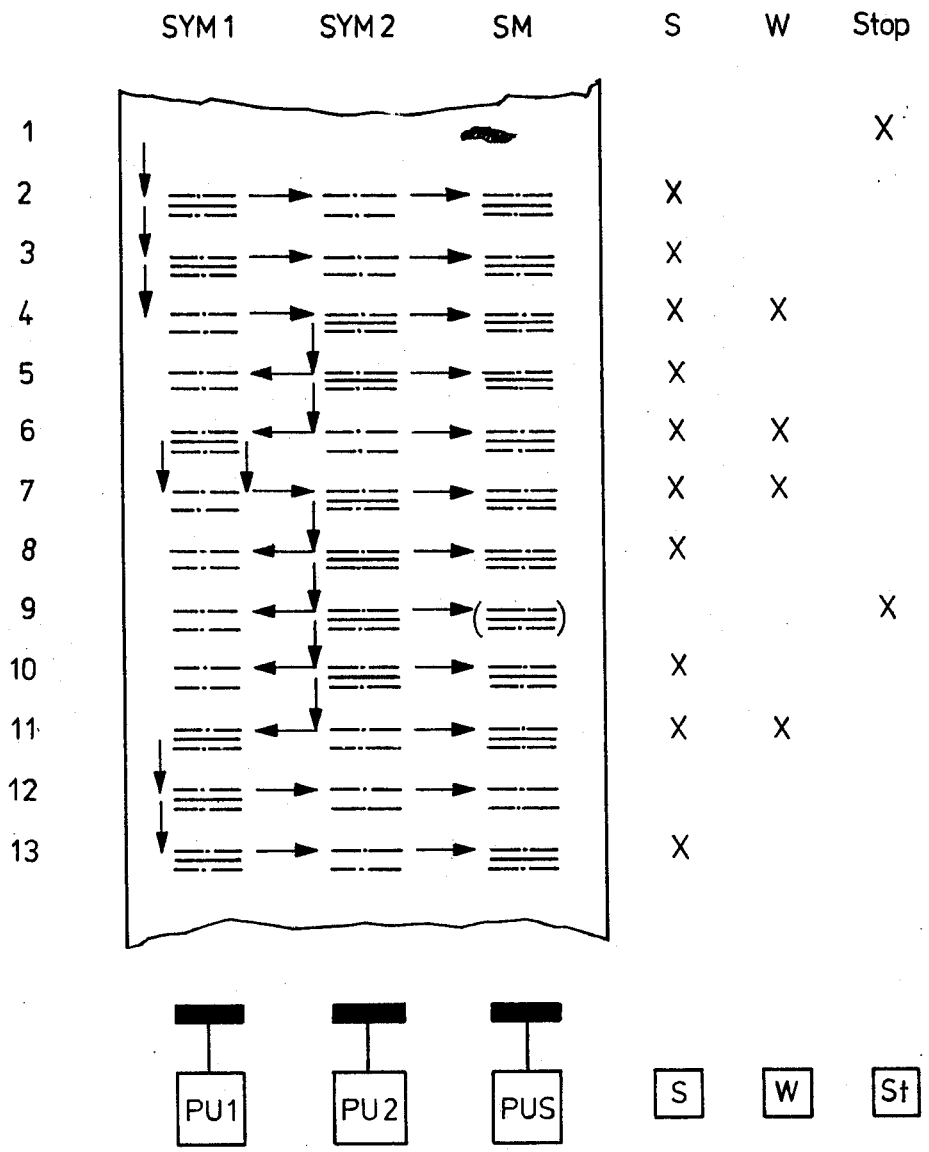

The arrangement of FIG. 5 corresponds basically to that of FIG. 4, except that in FIG. 5 the cut marks too must fall within a gating region corresponding to the enablement of a coincidence gate effected by a synchronizing mark.

Accordingly, in contrast to FIG. 4, in line 1 of FIG. 5 the surface defect in the cut mark track SM does not trigger the cutting means S, but instead activates the stop means S*t*, because of the absence of a synchronizing mark in the same line. In line 9, a synchronizing mark but no cut mark is detected; this likewise activates the stop means S*t*.

The changes of synchronizing track occurring in lines 4, 6, 7 and 11 effect activation of the order-separating means W in the manner already described with respect to previous embodiments.

Figure 6:
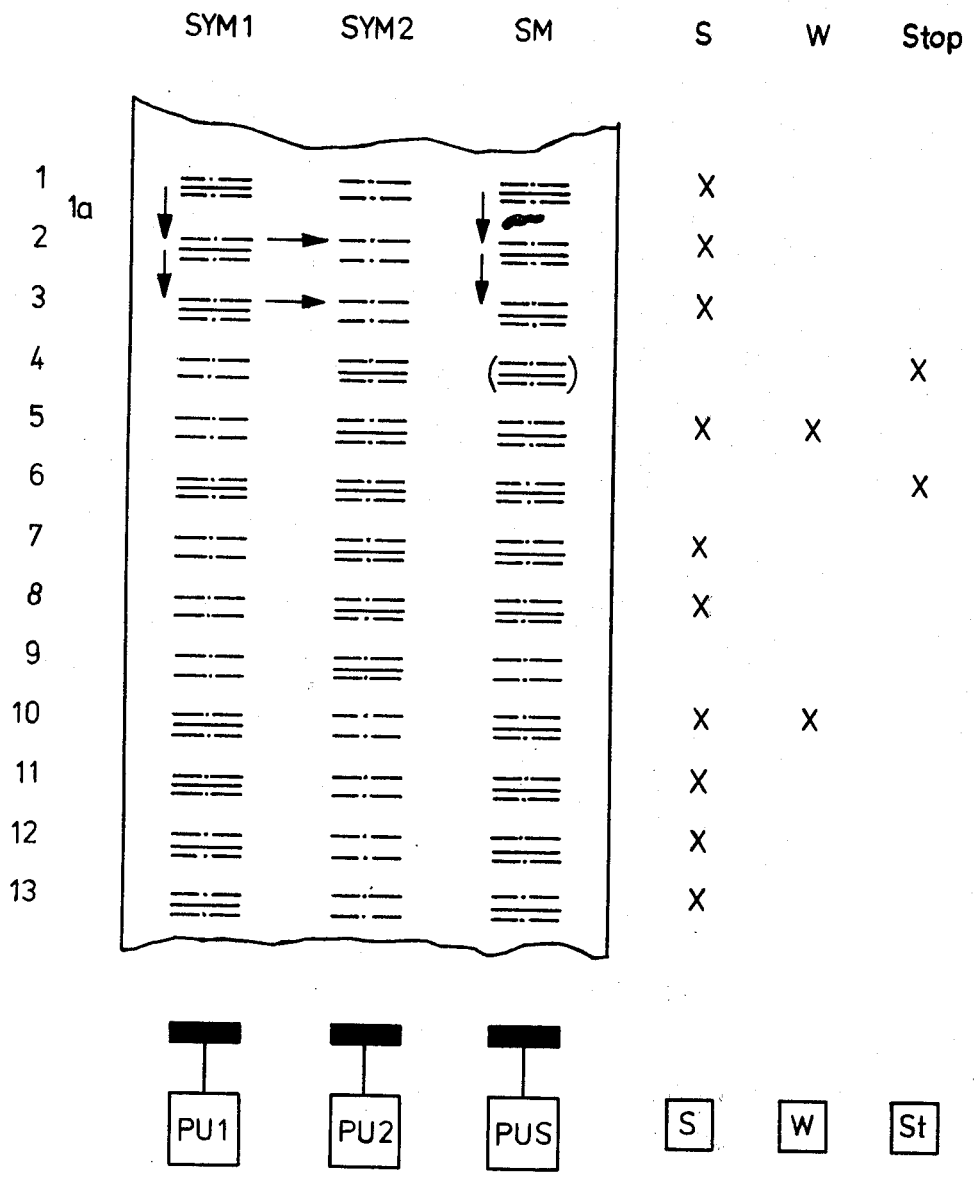

In the arrangement of FIG. 6, the gate enablement for the recognition of marks in the next-following line is effected not only by synchronizing marks but also by cut marks SM. This makes for high reliability with respect to cut location and order discrimination, and is achieved by modifying the arrangement of the photoelectric detectors PU1, PU2, PUS.

As indicated at the bottom of FIG. 6, the scanning regions for the three detectors are of the same size and exactly aligned. Accordingly, within a given line it makes no difference whether a cut mark precedes a synchronizing mark, or vice versa.

The system of FIG. 6 permits the automatic sorting out of empty strips to no greater an extent than the system of FIG. 5. However, the surface defect in the cut mark track in pseudo-line 1*a* activates neither the cutting means as in FIG. 4 nor the stop means as in FIG. 5; this is because the surface defect does not lie within the gating region established by the marks in line 1 for the marks in line 2. In other respects, the arrangement of FIG. 6 operates like that of FIG. 5.

Figure 7:
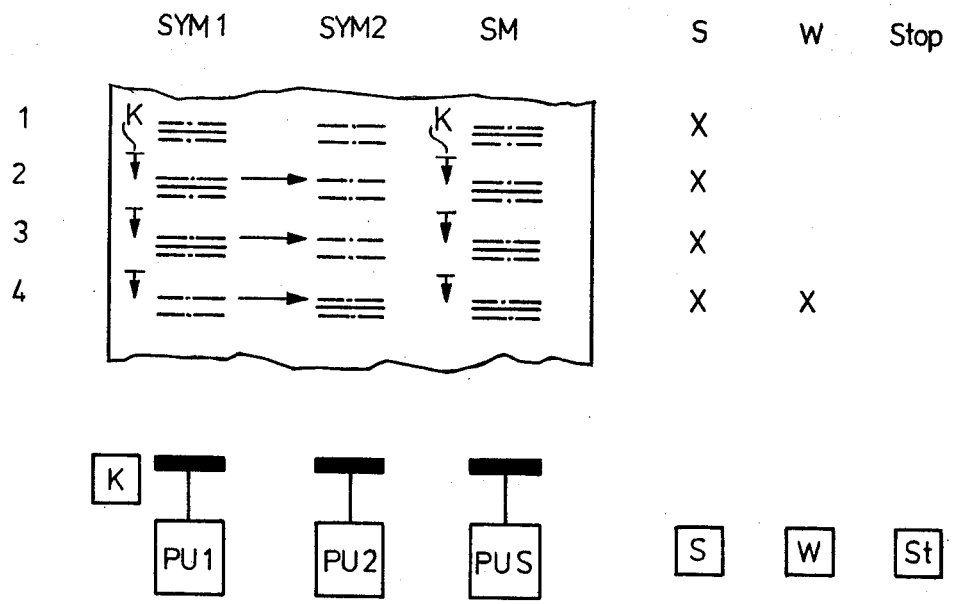

FIG. 7 depicts a modification of the approach illustrated in FIGS. 4–6, in which the gate enablement for the marks of a line is effected not by marks of the preceding line but instead by the cut edge of the respective preceding print. Such cut edge serves as a reference line for the positions of the gating regions for cut and synchronizing marks. The reliability of the detection is very high. This expedient is better applicable than those previously described where the film processing arrangement does not include means for monitoring the speed of travel or distance travelled by the band under transport. Accordingly, the use of means for indicating the distance travelled by the band, or for indicating that the band has travelled a certain distance subsequent to the start of timing, need not be used, although such means are necessary if marks in one line are to be used to effect gate enablement for the detection of marks in the next-following line.

The aforedescribed systems require two tracks and associated marking and detecting devices for the synchronizing marks. This presents no difficulty in the case of band rolls which are marked on their back sides, for example by means of stamping devices. However, with marking devices which form marks at the lateral edges of the band by exposing such portions to light, difficulties are encountered, because only two such lateral edges are available and the marks ordinarily must be located with a certain spacing from each other.

A synchronizing system (order coordinating system) equivalent to those described above can be created using only one synchronizing track by using two types of synchronizing marks or by using only one type but applying the marks in two different ways. This will be discussed with respect to the arrangements shown in FIGS. 8–11.

Figure 8:
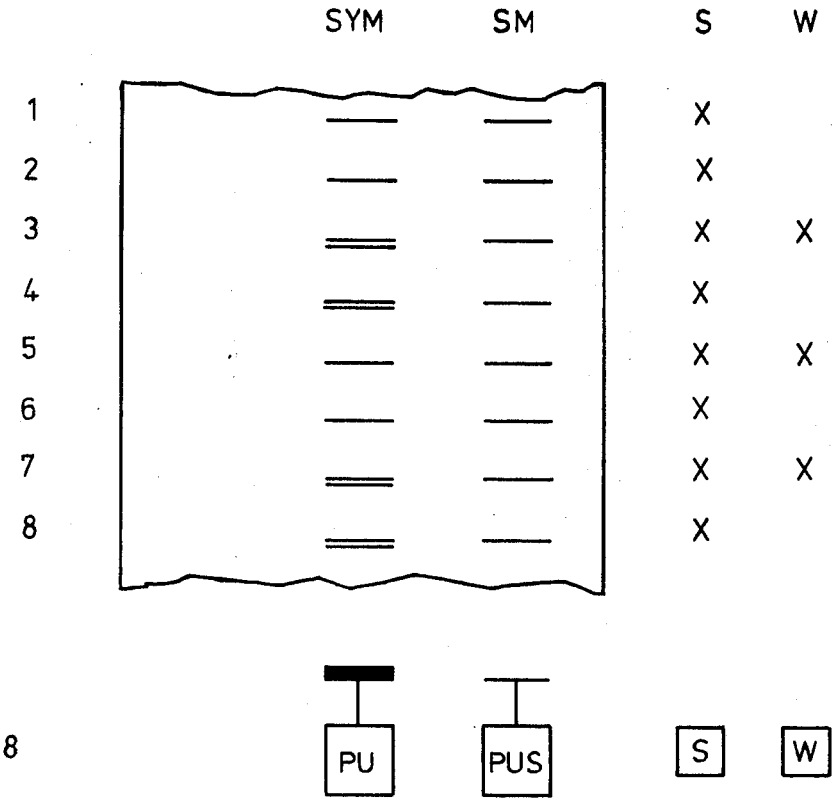
FIGS. 8–11 diagrammatically illustrate three versions of the invention, in which two tracks are used for marks, together with the various detecting and control arrangements involved.

FIG. 8 depicts a two-track arrangement, including one track SYM for synchronizing marks and another track SM for cut marks. Two different types of marks are applied to the synchronizing track SYM. A change of the mark type, occurring for example in going from lines 2 to 3, 4 to 5, and 6 to 7, activates the order-separating means W. In FIG. 8 the synchronizing marks are independent of each other; as a result, all the various possibilities described with respect to FIGS. 1–7 can be resorted to, as desired.

The marks of the two types can differ from each other in optical, mechanical or both optical and mechanical respects. For example, the marks of one type can be applied-on or exposed-on transverse lines, with the marks of the other type being edge notches or perforations. Alternatively, for example, the marks of the one type could be edge notches and those of the other type could be perforations or embossed markings. Or the marks of the two types could be embossed markings of different configuration and/or size.

It will be understood that mechanical markings (edge notches, circular perforations, embossed markings, etc.) can be detected using mechanical feelers, instead of photoelectric detectors.

Figure 9:
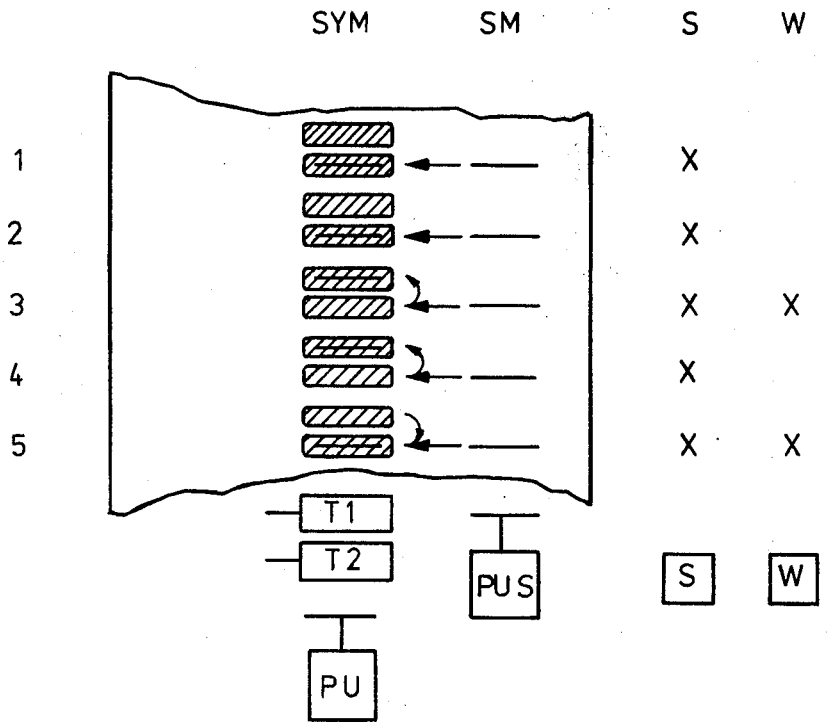

FIG. 9 depicts another way of arranging the marks in a single track, in which the marks are distinguishable from each other by virtue of their differing positions relative to the frame edge or the associated cut mark. Accordingly, each cut mark effects the enablement of two gates T1 and T2. In dependence upon whether successive synchronizing marks are detected by one and the same gate, or first by one gate and then the other, the order-separating means W is activated or not. The cut marks themselves in the embodiment of FIG. 9 directly trigger automatic cutting operations without conditions precedent implemented by the enablement of gates.

In this connection, use can be made either of one photoelectric detector for one synchronizing track cooperating with two timer gates, or else two photoelectric detectors arranged one downstream of the other and capable of being enabled simultaneously.

Figure 10:
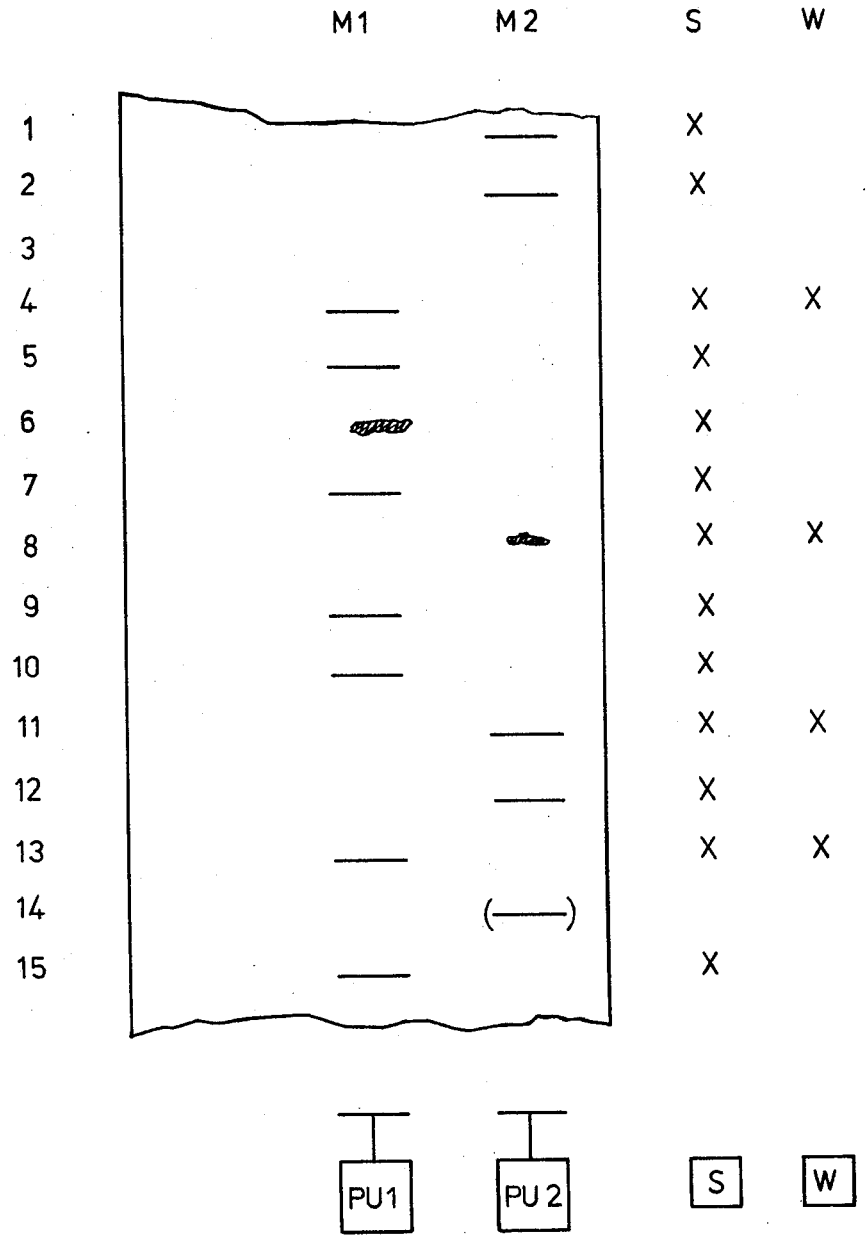

FIG. 10 depicts a further embodiment in which use is not made of separate cut marks. The marks M1 and M2 serve both to control synchronization (order coordination and separation) and cutting. As before, a change of track activates the order-separating means W. In the arrangement of FIG. 10 no gates are provided. As a result, for example the surface defect in line 8 triggers an improper order-separating operation. The mark in line 14 is unreadable, and as a result a cutting operation is improperly skipped; also, in the case of this particular line, the change of track fails to be detected, so that the reguisite order-separation operation fails to be performed, causing the picture associated with line 14 to be improperly attached to the preceding picture, which belonged to a different customer order. However, for the reasons explained earlier, these errors although possible occur relatively seldom if the marking is done well.

Figure 11:
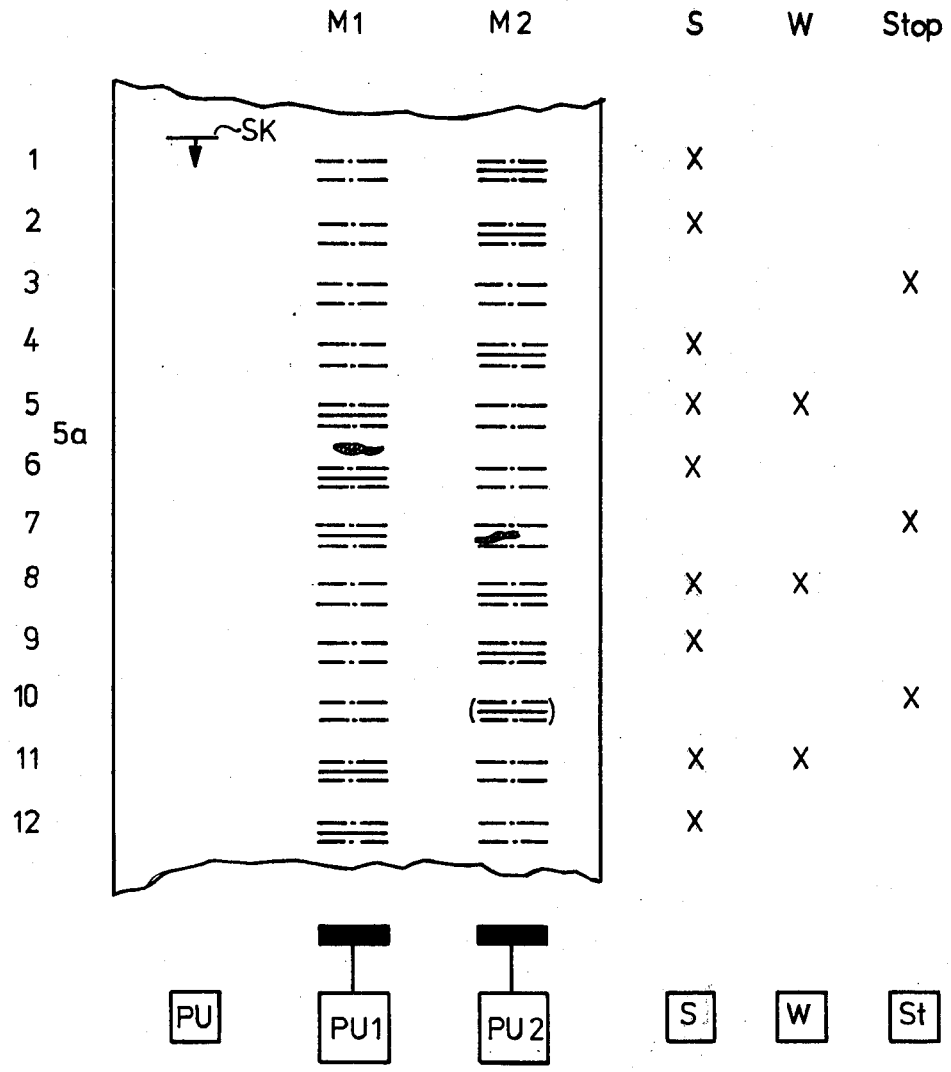

FIG. 11 depicts a similar arrangement with the addition of a gating circuit expedient. Here, the gate can be enabled either in response to detection of the edge of the preceding picture or in response to a preceding mark. The cut edge SK is detected by a separate detector PU. The provision of a gating circuit expedient here brings about considerable advantages; with respect to the detection of the end of an order, use can be made of an exclusive-OR criterion, because one and no more than one mark should be detected during gate enablement. This results in an unequivocal coordination of customer orders and cutting operations. A loss of synchronization (customer order mix-up or splitting) can occur only if during the enablement of the gate erroneous detections are made for both tracks, a very rare occurrence. What would have to occur in such event is the failure to read a mark in one track and the detection of a false mark in the other track during gate enablement. False marks or surface defects intermediate the locations corresponding to gate enablement (e.g., in pseudo-line 5*a*) cannot lead to malfunction. The stopping means S*t* is automatically activated in response to line 7 where two marks are detected during gate enablement, and in response to lines 3 and 10 where no marks are detected during gate enablement. The order-separating means W as before is automatically activated in response to a change of synchronizing track, such as occurs in going from line 4 to 5, 7 to 8, and 9 to 11.

Figure 12:
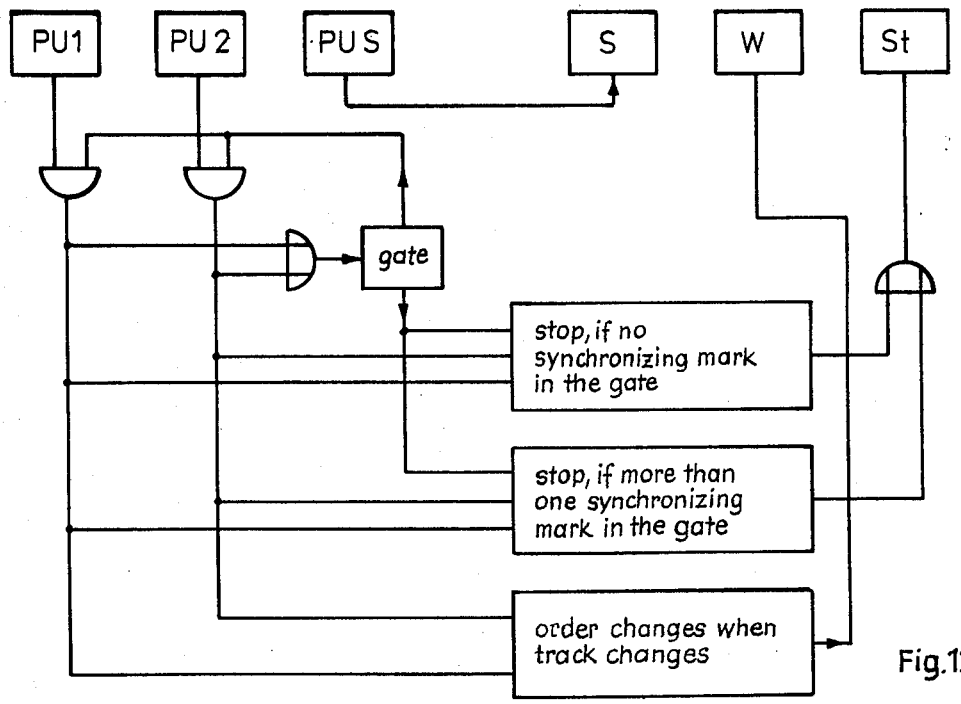
FIG. 12 is a block circuit diagram for implementing the version of the invention illustrated in FIG. 4.
Figure 13:
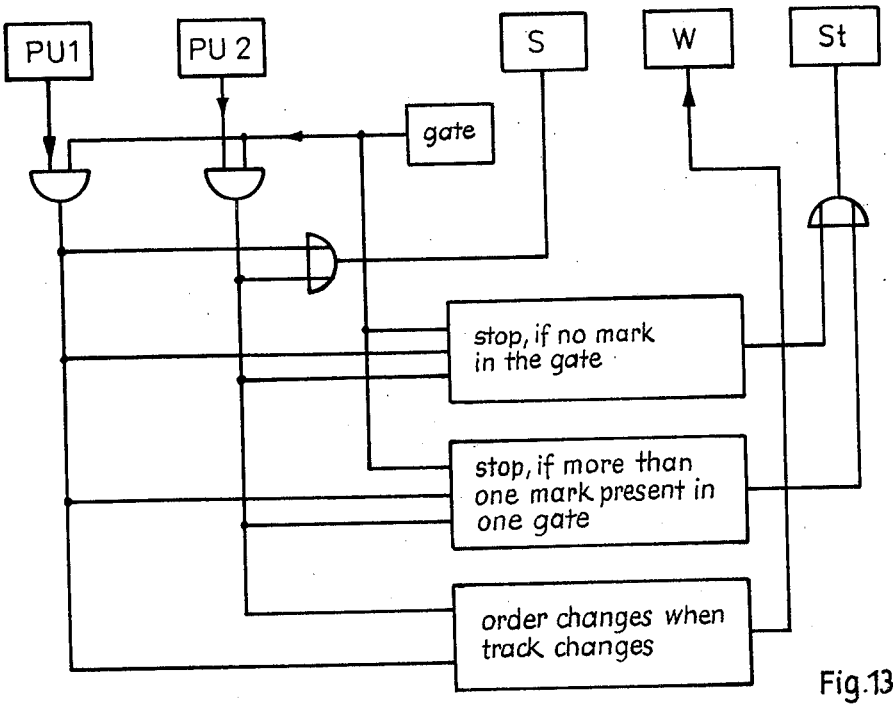
FIG. 13 is a block circuit diagram for implementing the version of the invention illustrated in FIG. 11.
Figure 14:
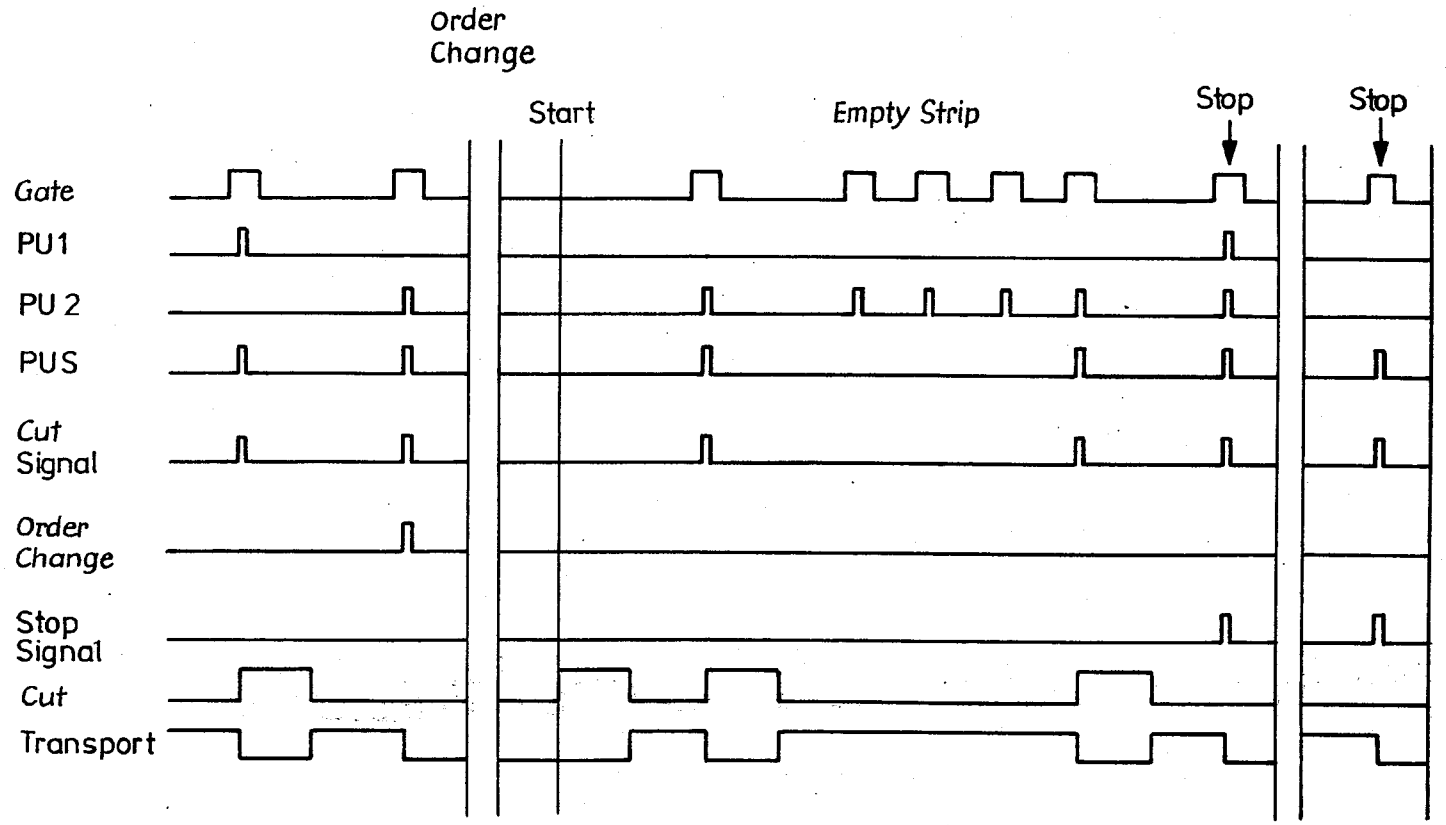
FIG. 14 is a pulse diagram illustrating the operation of the circuit of FIG. 12.
Figure 15:
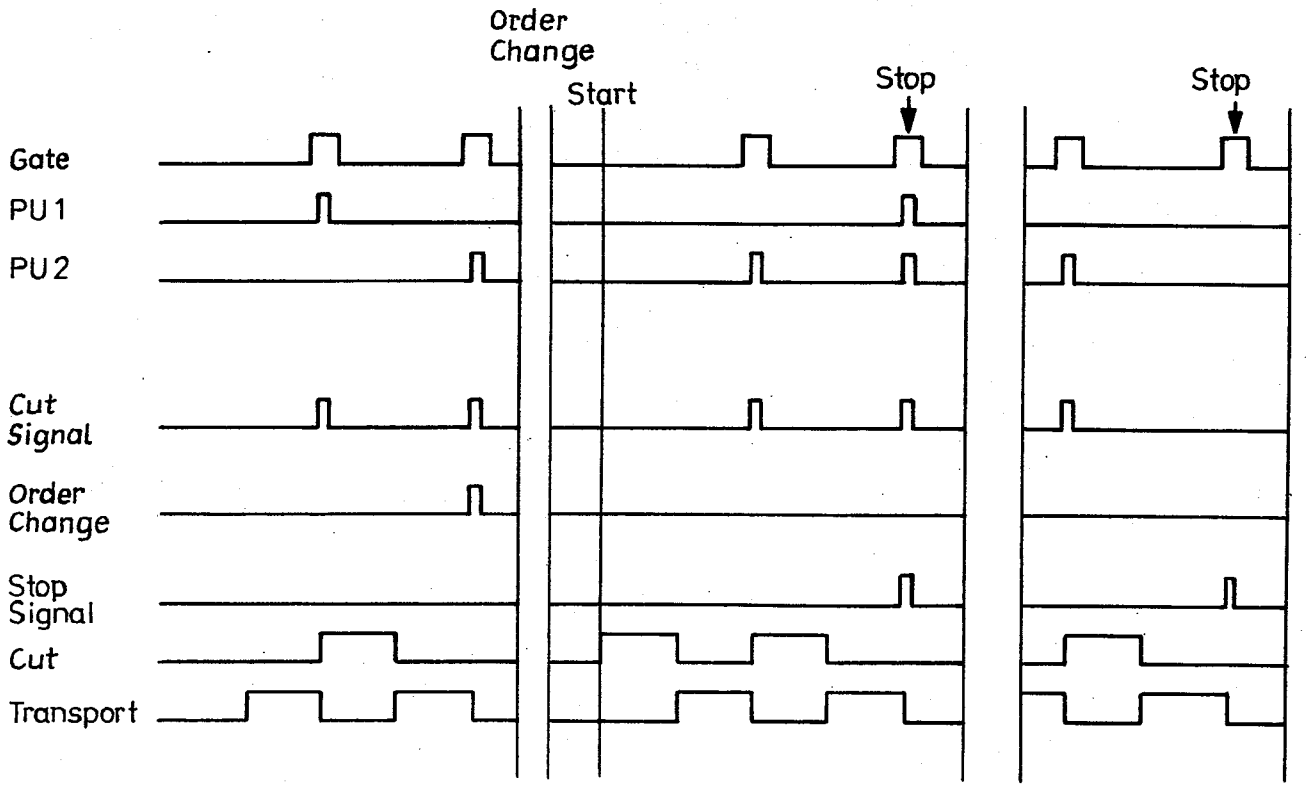
FIG. 15 is a pulse diagram illustrating the operation of the circuit of FIG. 13.

FIGS. 12 and 13 show detailed schematic block diagrams of logic circuits which can be used with the embodiments of FIGS. 4 and 11. FIGS. 14 and 15 are pulse diagrams respectively corresponding to FIGS. 12 and 13.

In FIGS. 12 and 14, a synchronizing mark detected by either one of the detectors PU1, PU2 during the enablement of the coincidence gate effected by the detection of a synchronizing mark in the preceding line in turn effects the enablement of the coincidence gate for the detection of a synchronizing mark in the next-following line. In the event that during the enablement of the coincidence gate for a particular line no marks or two marks are detected in that line, then the stop means S*t* is automatically activated. The discrimination between successive customer orders is made on the basis of the change of synchronizing track. A cutting mark SM detected by the associated detector PUS activates the cutting means S independently of any other mark in the line. Empty strips provided with synchronizing marks but no cut marks are sorted out after an automatic cutting operation.

In FIGS. 13 and 15 the gate is for example set for a particular line by the preceding picture cut edge. Any mark detected in a line during gate enablement for that line activates the cutting means S. If no mark or two marks are detected in a line during gate enablement for that line, then the stop means S*t* is activated.

It will be understood that each of the elements described above, or two or more together, may also find a useful application in other types of logic circuit expedients differing from the types described above.

While the invention has been illustrated and described as embodied in a particular logic circuit expedients, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. A method of processing a plurality of customer orders, wherein each customer order has the form of a segment of an image band, each segment being comprised of one or more image sections bearing respective images, particularly for use in an automated processing laboratory, comprising, in combination, the steps of providing the image band with order marks of different types, each image section of one customer order being provided with an order mark of one type and each image section of the next customer order being provided with an order mark of another type so that the order mark type changes from one customer order to the next on the image band; detecting the changes of order mark type using detecting means operative for generating control signals depending upon such detection; severing the image band at intervals to form band sections to be sorted, each band section being constituted by at least one image section; and controlling the operation of an order-sorting means by applying the control signals thereto.

2. The method defined in claim 1, wherein said step of providing the image band with order marks comprises providing the image band with order marks of two different types, each image section of one customer order being provided with an order mark of one type and each image section of the next customer order being provided with an order mark of the other type so that the order mark types alternate in going from one customer order to the next on the image band.

3. The method defined in claim 1, wherein in said step of providing the image band with order marks comprises providing the image band with order marks located in different order mark tracks, each image section of one customer order being provided with an order mark in one order mark track and each image section of the next customer order being provided with an order mark in another order mark track so that the order mark track in which order marks are located changes from one customer order to the next on the image band.

4. The method defined in claim 1, wherein said step of providing the image band with order marks of different types comprises providing all the order marks in a single order mark track, with all the order marks occupying the same positions relative to the associated image sections.

5. The method defined in claim 1, wherein said step of providing the image band with order marks of different types comprises providing the order marks on a plurality of order mark tracks with the order marks of one type differing from the order marks of a different type with respect to the track in which the order marks are located.

6. The method defined in claim 1, the order marks being furthermore used for indicating that severing of associated image sections from the image band is to be effected, wherein said step of detecting includes detecting the individual order marks using detecting means operative for generating control signals in dependence upon the detection of individual order marks, and wherein said step of severing furthermore comprises controlling the operation of cutting means by applying thereto the control signals generated in dependence upon the detection of individual order marks.

7. The method defined in claim 1, wherein said step of providing furthermore includes providing each image section of the image band with a cut mark for indicating that severing of the image section from the image band is to be effected, wherein said step of detecting furthermore includes detecting the coincident presence of one order mark and one cut mark both associated with the same section and having relative positions falling within a predetermined limited range of relative positions using detecting means operative for generating control signals in dependence upon the detection of such coincident presence, and wherein each step of severing furthermore comprises controlling the operation of cutting means by applying thereto the control signals generated in dependence upon the detection of such coincident presence.

8. The method defined in claim 7, wherein said step of detecting further includes detecting the improper coincident presence of a cut mark and other than one order mark associated with the same image section and having relative positions falling within the predetermined limited range of relative positions using detecting means operative for generating control signals in dependence upon the detection of the improper coincident presence, and wherein said step of controlling furthermore comprises activating stop means for interrupting band transport by applying to the latter the control signals generated in dependence upon the detection of the improper coincident presence.

9. The method defined in claim 7, wherein said step of detecting the proper coincident presence of an order mark and a cut mark both associated with the same image section and having relative positions falling within the predetermined limited range of relative positions includes establishing the predetermined limited range of relative positions in response to the detection of at least one mark associated with the preceding image section.

10. The method defined in claim 9, wherein said step of detecting further includes detecting the improper coincident presence of a cut mark and other than one order mark associated with the same image section and having relative positions falling within the predetermined limited range using detecting means operative for generating control signals in dependence upon the detection of the improper coincident presence, and wherein said step of controlling furthermore comprises activating stop means for interrupting band transport by applying to the latter the control signals generated in dependence upon the detection of the improper coincident presence.

11. The method defined in claim 9, wherein said step of detecting further includes detecting the improper presence of a cut mark outside the predetermined limited range of positions and detecting the improper absence of a cut mark inside the predetermined limited range of positions using detecting means operative for generating control signals in dependence upon the detection of such improper presence or absence of a cut mark, and wherein said step of controlling furthermore comprises activating stop means for interrupting band transport by applying to the latter the control signals generated in dependence upon the detection of such improper presence or absence of a cut mark.

12. The method defined in claim 1, wherein said step of providing furthermore includes providing each image section of the image band with a cut mark for indicating that severing of the image section from the image band is to be effected, wherein said step of detecting furthermore includes detecting the presence of an order mark in a first predetermined limited range of positions and detecting the presence of a cut mark in a second predetermined limited range of positions using detecting means operative for generating control signals in dependence upon such detection, and wherein said step of severing furthermore comprises controlling the operation of cutting means by appyling thereto the control signals generated in dependence upon the detection of the order mark in the first and the cut mark in the second predetermined ranges.

13. The method defined in claim 12, wherein said detecting of the order mark in the first and the cut mark in the second predetermined range includes establishing the first and second predetermined ranges of positions in respective response to detection of an order mark and a cut mark associated with the respective preceding image section.

14. The method defined in claim 13, wherein said step of detecting furthermore comprises detecting the improper absence of an order mark in the first range of positions, the improper presence of more than one order mark in the first range of positions, and the improper absence of a cut mark in the second range of positions using detecting means operative for generating control signals in response to detection of such improper presence or absence, and wherein said step of controlling furthermore comprises activating stop means for interrupting band transport by applying to the latter control signals generated in dependence upon the detection of such improper presence or absence.

15. The method defined in claim 12, wherein said detecting of an order mark and a cut mark in the first and second predetermined ranges furthermore comprises establishing the predetermined ranges of positions for the order and cut marks in response to the detection of the cut edge of the preceding image section.

16. The method defined in claim 15, wherein said step of detecting furthermore includes detecting in the predetermined ranges the improper presence of only a single mark and the improper presence of more than two marks using detecting means operative for generating control signals in response to the detection of such improper presence, and wherein said step of controlling comprises activating stop means for interrupting band transport by appyling to the latter control signals generated in response to the detection of such improper presence.

17. The method defined in claim 4, wherein said step of providing furthermore includes providing each image section of the image band with a cut mark for indicating that severing of the image section from the image band is to be effected, wherein said step of detecting furthermore includes detecting the presence of cut marks using detecting means operative for generating cut control signals in response to such detection and detecting the change of order mark type using detecting means operative for generating change-of-type control signals in response to such detection, and wherein said step of severing furthermore comprises controlling the operation of cutting means by applying thereto the cut control signals, said controlling step comprising controlling the operation of order-sorting means by applying thereto the change-of-type control signals.

18. The method defined in claim 5, wherein said step of providing furthermore includes providing each image section of the image band with a cut mark for indicating that severing of the image section from the image band is to be effected, and wherein the providing of order marks of different types comprises providing order marks of different types comprises providing order marks which differ from each other in type with respect to their position relative to their associated image sections as considered in the longitudinal direction of the image band, and wherein said step of detecting furthermore includes detecting the coincident presence of a cut mark and an order mark in any of a plurality of predetermined limited ranges of relative positions corresponding to the different types of order marks and detecting order mark type changes but only as between order marks located in any of said ranges using detecting means operative for generating change-of-type control signals in response to such detection, and wherein said step of severing furthermore comprises controlling the operation of cutting means by applying thereto the control signals dependent upon the detection of such coincident presence, said controlling step comprising controlling the operation of order-sorting means by applying thereto the control signals dependent upon the detection of the change of order mark type.

19. The method defined in claim 3, wherein said step of detecting includes establishing for each individual image section a plurality of predetermined limited ranges of positions respectively corresponding to the plurality of order mark tracks in dependence upon the detection of a predetermined characteristic of the respective preceding image section using detecting means operative for detecting such predetermined characteristic of the preceding section, detecting for each image section the proper presence of only a single order mark in a single one of the ranges, the improper presence of no order mark in any of the ranges, the improper presence of more than one order mark in any of the ranges, the improper presence of more than one order mark in a plurality of the ranges and changes of order mark track using detecting means operative for generating control signals in response to such detection, and wherein said step of controlling comprises controlling the operation of cutting means by applying thereto the control signals generated in dependence upon the detection of the proper presence of only a single order mark, controlling the operation of order-sorting means by applying thereto the control signals generated in dependence upon the detection of changes of order mark track, and controlling the operation of means for interrupting band transport by applying thereto the control signals generated in dependence upon the detection of the improper presence of other than a single order mark in a single range.

20. The method defined in claim 19, the predetermined characteristic of the preceding image section being the cut edge of the preceding image section.

21. The method defined in claim 19, the predetermined characteristic of the preceding image section being an order mark of the preceding image section.

22. The method defined in claim 4, wherein said step of detecting includes establishing for each individual section a predeterined limited range of positions in dependence upon the detection of a predetermined characteristic of the respective preceding image section using detecting means operative for detecting such predetermined characteristic of the preceding section, detecting for each image section the proper presence of only a single order mark in the predetermined range, the improper absence of order marks in the predetermined range and changes of order mark form using detecting means operative for generating control signals in response to such detection, and wherein said step of severing comprises controlling the operation of cutting means by applying thereto the control signals generated in dependence upon the detection of the proper presence of only a single order mark, said controlling step comprising controlling the operation of order-sorting means by applying thereto the control signals generated in dependence upon the detection of changes of order mark form and controlling the operation of means for interrupting band transport by applying thereto the control signals generated in dependence upon the detection of the improper absence of an order mark in the predetermined range.

23. The method defined in claim 22, the predetermined characteristic of the preceding image section being the cut edge of the preceding image section.

24. The method defined in claim 19, the predetermined characteristic of the preceding image section being an order mark of the preceding image section.

25. An arrangement for processing a plurality of customer orders, wherein each customer order has the form of a segment of an image band, each segment being comprised of one or more image sections bearing respective images, particularly for use in an automated processing laboratory, and wherein the image sections of one customer order are provided with marks of one type and the image sections of the next customer order are provided with marks of another type so that the mark type changes from one customer order to the next on the image band, comprising, in combination, cutting means activatable for severing an image section from the image band: order-sorting means activatable for sorting the image sections in dependence upon the customer order to which they belong; and control means operative for detecting the marks on the individual image sections and also changes in mark type and operative for activating said cutting means and said order-sorting means in dependence upon such detection.

26. The arrangement defined in claim 25, wherein the marks are arranged in a plurality of tracks on the image band, with the marks of one type differing from those of another type with respect to the track in which they are located, and wherein said control means comprises means operative for detecting changes in mark type by detecting changes in the track in which marks are located.

* * * * *